US012116199B2

(12) United States Patent
Young et al.

(10) Patent No.: US 12,116,199 B2
(45) Date of Patent: Oct. 15, 2024

(54) DISPENSER ASSEMBLY FOR DISPOSABLE LIDS

(71) Applicant: CFS Brands, LLC, Oklahoma City, OK (US)

(72) Inventors: Michael Young, Mukwonago, WI (US); Jarod Sulik, Elkhorn, WI (US); Rebecca L. Hyma, Warrenville, IL (US)

(73) Assignee: CFS Brands, LLC, Oklahoma City, OK (US)

( * ) Notice: Subject to any disclaimer, the term of this patent is extended or adjusted under 35 U.S.C. 154(b) by 439 days.

(21) Appl. No.: 17/552,673

(22) Filed: Dec. 16, 2021

(65) Prior Publication Data

US 2023/0192389 A1 Jun. 22, 2023

(51) Int. Cl.
*B65D 83/04* (2006.01)
*B65D 83/08* (2006.01)

(52) U.S. Cl.
CPC ..... *B65D 83/0858* (2013.01)

(58) Field of Classification Search
CPC ..... B65D 83/0858; B65D 83/04; A47F 1/065; A47F 1/085; A47F 1/106
See application file for complete search history.

(56) References Cited

U.S. PATENT DOCUMENTS 3,163,323 A 12/1964 Behrens et al.
3,565,284 A 2/1971 Hinterreiter et al.
4,234,101 A 11/1980 Pastore
4,243,153 A 1/1981 Mitchell
4,319,441 A 3/1982 Credle
4,643,334 A 2/1987 Steele
4,804,108 A 2/1989 Ficken
4,854,479 A 8/1989 Callahan et al.
4,949,526 A 8/1990 Brogna et al.
5,012,952 A * 5/1991 Franz ..... G07F 13/10 221/59
5,071,033 A 12/1991 Siwek
5,135,136 A 8/1992 Moone
(Continued)

FOREIGN PATENT DOCUMENTS

BR PI1002856 A2 4/2012
CA 2010195 A 8/1991
(Continued)

*Primary Examiner* — Patrick H Mackey
(74) *Attorney, Agent, or Firm* — Boyle Fredrickson, S.C.; Kirk L. Deheck; Adam L. Brookman

(57) ABSTRACT

An assembly and method of forming a disposable container lid dispenser assembly and which is constructed to sequentially dispense respective container lids from a stack of container lids housed in the dispenser assembly. The dispenser assembly is generally defined by a tube, a pressure plate assembly and a door assembly. The door assembly is movable relative to the tube to allow loading of the tube with a stack of lids and supports a cover that is moveable relative to a door. The door and cover cooperate with one another to define an extraction gap shaped to allow manual extraction of a discrete lid from the stack of lids contained in the dispenser assembly. A plurality of deflectable projections extend across the extraction gap and operate to ensure separation of discrete lid from the remainder of the stack of lids during each extraction event.

24 Claims, 11 Drawing Sheets

(56) References Cited

U.S. PATENT DOCUMENTS

| | | | | |
|---|---|---|---|---|
| 5,152,120 | A | 10/1992 | Huang | |
| 5,191,996 | A | 3/1993 | Jenkins | |
| 5,328,052 | A | 7/1994 | Kizilos | |
| 5,383,571 | A | 1/1995 | Gunderson | |
| 5,513,096 | A | 4/1996 | Casler, Jr. et al. | |
| 5,845,791 | A | 12/1998 | Kawolics | |
| 5,944,220 | A | 8/1999 | Garske et al. | |
| 5,960,989 | A | 10/1999 | Gunderson | |
| 5,975,839 | A | 11/1999 | Ashby | |
| 6,003,724 | A * | 12/1999 | Collins | A47F 1/065 221/221 |
| 6,357,624 | B1 | 3/2002 | Brown | |
| 6,474,503 | B2 | 11/2002 | Davis | |
| 6,659,305 | B2 | 12/2003 | Thompson | |
| 6,786,359 | B1 | 9/2004 | Schroeder | |
| 6,832,698 | B1 | 12/2004 | Dybul | |
| 6,966,454 | B2 | 11/2005 | Kawolics et al. | |
| 6,971,545 | B2 | 12/2005 | Martinez et al. | |
| 7,207,462 | B2 | 4/2007 | Gunderson et al. | |
| 7,234,611 | B2 | 6/2007 | Hecht | |
| 7,270,248 | B2 | 9/2007 | Schroeder | |
| 7,337,919 | B2 | 3/2008 | Walsh et al. | |
| 7,422,127 | B2 | 9/2008 | Christoffersen et al. | |
| 7,669,732 | B2 | 3/2010 | Njaastad | |
| 7,882,980 | B1 | 2/2011 | Horn et al. | |
| 7,900,797 | B1 | 3/2011 | Witcraft | |
| 8,025,181 | B1 | 9/2011 | Horn et al. | |
| 8,061,556 | B2 | 11/2011 | Sands et al. | |
| 8,490,834 | B2 | 7/2013 | Edwards et al. | |
| 8,789,723 | B2 | 7/2014 | Gunderson | |
| 8,839,987 | B2 | 9/2014 | Doglioni Majer | |
| 8,893,922 | B2 | 11/2014 | Azzano et al. | |
| 9,049,949 | B1 | 6/2015 | Taylor | |
| 9,141,562 | B2 | 9/2015 | Pickett et al. | |
| 9,150,366 | B2 | 10/2015 | Rudick et al. | |
| 9,189,912 | B2 | 11/2015 | Gunderson | |
| 9,227,830 | B2 | 1/2016 | Angus et al. | |
| 9,251,640 | B2 | 2/2016 | Walsh et al. | |
| 9,271,582 | B1 | 3/2016 | Pando | |
| 9,339,122 | B2 | 5/2016 | Frankel | |
| 10,366,560 | B2 | 7/2019 | Weber et al. | |
| 10,370,174 | B1 | 8/2019 | McIntosh | |
| 10,529,165 | B2 | 1/2020 | Marquis et al. | |
| 10,945,517 | B1 | 3/2021 | Gilbar et al. | |
| D921,396 | S | 6/2021 | McCauley et al. | |
| 11,524,836 | B1 * | 12/2022 | Hochberg | B65D 83/00 |
| 2004/0084472 | A1 | 5/2004 | Thompson | |
| 2004/0251157 | A1 | 12/2004 | Behnke et al. | |
| 2005/0242107 | A1 | 11/2005 | Kosmyna et al. | |
| 2005/0247724 | A1 * | 11/2005 | Gapp | B65D 83/0817 221/279 |
| 2006/0091147 | A1 | 5/2006 | Arndt | |
| 2006/0113315 | A1 | 6/2006 | Chen | |
| 2006/0226169 | A1 | 10/2006 | Davis et al. | |
| 2009/0057334 | A1 | 3/2009 | Pearl et al. | |
| 2010/0187248 | A1 * | 7/2010 | Popp | A47F 1/085 221/282 |
| 2011/0101017 | A1 | 5/2011 | Schroeder et al. | |
| 2013/0306670 | A1 | 11/2013 | Haubenstock | |
| 2014/0263395 | A1 * | 9/2014 | Gunderson | G07F 11/70 221/221 |
| 2014/0305962 | A1 * | 10/2014 | Tschan | A47F 1/085 221/221 |
| 2015/0320236 | A1 | 11/2015 | Paradise et al. | |
| 2016/0358405 | A1 | 12/2016 | Izoita et al. | |
| 2017/0225873 | A1 * | 8/2017 | Fougere | B65D 83/0418 |
| 2018/0222737 | A1 | 8/2018 | Zhou | |
| 2020/0077811 | A1 * | 3/2020 | O'Brien | A47F 1/06 |

FOREIGN PATENT DOCUMENTS

| | | | |
|---|---|---|---|
| CN | 200971225 | Y | 11/2007 |
| CN | 108922042 | A | 11/2018 |
| CN | 109436404 | A | 3/2019 |
| CN | 208722314 | U | 4/2019 |
| CN | 209015310 | U | 6/2019 |
| CN | 110164045 | A | 8/2019 |
| CN | 210488670 | U | 5/2020 |
| CN | 111348232 | A | 6/2020 |
| CN | 111358296 | A | 7/2020 |
| DE | 202009012803 | U1 | 12/2009 |
| DE | 202009011731 | U1 | 3/2010 |
| DE | 202013101550 | U1 | 6/2013 |
| DE | 202021001252 | U1 | 5/2021 |
| EP | 0700831 | A2 | 3/1996 |
| EP | 1887533 | A2 | 2/2008 |
| EP | 2017800 | A2 | 1/2009 |
| EP | 2445622 | A1 | 5/2012 |
| EP | 2460442 | A1 | 6/2012 |
| EP | 2568454 | A2 | 3/2013 |
| EP | 3586236 | A1 | 1/2020 |
| GB | 2302327 | A | 1/1997 |
| GB | 2498538 | A | 7/2013 |
| JP | 2008178534 | A | 8/2008 |
| MX | 2010000148 | A | 10/2010 |
| RU | 2747507 | C1 | 5/2021 |

* cited by examiner

DISPENSER ASSEMBLY FOR DISPOSABLE LIDS

FIELD OF THE INVENTION

The present invention relates generally to dispensers for convenience stores, food service activities, and fast-food operations and, more particularly, to a dispenser assembly that is constructed to dispense, in a sequential manner, lids that are constructed to engage disposable containers such as coffee, other beverage cups, soup containers, or the like.

BACKGROUND OF THE INVENTION

Organizers for beverage and other disposable or single use container lids have been employed for many years. Such organizers are widely used in various environments including food service, convenience store, and fast-food operations to name a few. In rudimentary forms, a stack of lids is typically supported in a trough or a shaped holder. This basic concept has taken many forms. In most, lids are substantially exposed to the environment in either a vertical, partially vertical, or substantially horizontal arrangement. Such configurations commonly include vertically oriented partitioned boxes having open or see-through channels or fronts into which one or more stacks of lids are placed. When more than one stack is supported, each stack can be partitioned off from other stacks such that a plurality of stacks is displayed in side-by-side relation. In this configuration there is normally a wide slot that runs along the longitudinal axis of the stack to permit a user's fingers to access the stack of lids with the intended objective of grasping or removing a desired number of lids either from an open top or an enlarged mouth near the top or bottom of the dispenser to permit the grasped lid/lids to be withdrawn or removed from the dispenser. In other embodiments of this configuration, there are merely bars or corner pieces that restrain the stack of lids from tipping over, but otherwise such approaches provide negligible protection of the discrete lids or stack of lids from exposure to the environment of use and/or inadvertent contact by users with more lids than are desired.

Another common approach to dispensing container lids is an arrangement of one or more vertically oriented tubes; each having a wide elongated opening running along the longitudinal axis of a stack of lids positioned in the tube. These tubes are most often formed from thin pieces of metal such as aluminum or stainless steel, but can also be formed from a wire mesh material. In such configurations, the elongated slot is generally quite wide such that a lid can be pulled straight out of the tube with some slight flexure or such that a lid can be rotated slightly and removed. Tube configurations of this type often have platforms at various heights along the inside of the vertical length of the tube so that multiple sizes and/or types of lids can be dispensed from a single tube.

Lids are also sometimes organized horizontally or at a 30-45 degree angle. In such cases the lids usually rest in a trough with access to the front or back of the respective stack of lids. Often there is an access opening for the lids that is substantially as wide as the lids' diameter, but is restricted by two or more tabs. In such cases a user simply grasps the exposed lid and pulls it. The lid then flexes to allow the lid to be pulled out past the restriction imposed by the tabs and thereby also manually removed or extracted from the lid dispenser.

Most of the above-described lid dispensing solutions fail to protect the lids from contamination and/or from being inadvertently knocked over. Recently, in order to provide more sanitary conditions and to improve the dispensing of lids, others have been developed lid dispensers that seek to address these issues. One such lid dispenser assembly is disclosed in U.S. Pat. No. 5,960,989. This dispenser houses the lids completely in sealed tubes with dispensing "units" at one end. The dispensing unit comprises a hinged receiver that engages the bottommost lid in a lid stack and then presents that single lid to the user when the hinged receiver is rotated away from the tube mouth. "Bottommost" as used herein is not intended to be limiting in terms of orientation. Rather, it is merely intended to identify the first (or last) lid in a stack of lids. Operation and user interaction with the dispenser assembly is not particularly intuitive and thereby renders the dispenser assembly susceptible to vandalism and/or damage due to the imposition of excessive forces during user interaction therewith.

Further, operation of the dispenser assembly associated with the '989 patent includes various moving parts that are intended to "grasp" an exterior facing contour of a discrete lid being dispensed so as to effectuate the desired removal of the currently dispensing lid from the remainder of the stack of lids contained in the dispenser. Slight deviations relative to the configuration of the stack of lids or the presentation face associated therewith can result in fouling or jamming of the dispense operations, inadvertent concurrent extraction of multiple lids, and/or forceful removal of the lids from the dispenser assembly in a manner that damages the lid or the perimeter thereof rendering the dispensed lid unsuitable for sealing cooperation with an underlying cup or container.

Another lid dispenser assembly is disclosed in U.S. Patent Application Publication No. 2005/0247724. This dispenser assembly includes a fully enclosed tube having a spring-biased pusher platform that biases the lids contained in the tube toward a dispense slot associated with a mouth of the tube and a partial cover assembly that is affixed thereat. A hinge clip is attached to a trim ring such that the cover can be rotated to a position that does not obstruct or overlie the cavity of the tube such that a sleeve of lids can be fed into the tube. During extraction, discrete lids are grasped at the front edge of a bottommost lid and placing a thumb or a finger on the lid in the notch and forcing the bottommost lid through the lid slot.

While this lid dispenser provides certain advantages over other prior art lid dispensers, it suffers from several significant drawbacks. The partial cover assembly is cumbersome and expensive to manufacture. Additionally, one or more tools are commonly required to replace the lid or hinge during loading operations. Further, the size of the opening defined by the partial cover assembly is relatively large such that the dispensers will not always reliably function properly to dispense lids one at a time and in a manner that facilitates separation between adjacent lids of the stack of lids in a manner that limits user interaction, and thereby a sanitary condition of adjacent lids. Further still, each extraction event relies on at least partial deformation of a respective bottom most lid during separation of the bottommost lid from the remainder of the stack of lids. Deformation of the lid during an extraction event presents the potential for splitting or other damage to the discrete extracted lids and thereby renders the extracted lid incapable of sealing operation with a cup or other container. Such instances, if unnoticed, leave the user susceptible to unexpected or unanticipated separation of the lid from an underlying container, inadvertent leakage or spillage of the contents thereof, or, if noticed, undesired waste of such inadvertently damaged lids.

Accordingly, there is a need for a dispenser assembly for disposable lids that maintains a sanitary condition or isolates a supply of lids from access by the user until dispensed, facilitates efficient and repeatable separation between discrete adjacent lids, facilitates the separation in a manner that does not damage a lid being dispensed or lids associated with the stack or lids contained therein, and is convenient to load and whose operation is intuitive to both users and service personnel.

SUMMARY OF THE INVENTION

The present invention provides numerous advantages over the prior art. The present invention permits the storage and sequential dispensing of individual lids such that the lids are substantially shielded from the environment and users of the dispenser assembly until a discrete dispense event. This results in a marked improvement in the preservation of the overall sanitary condition of lids associated with the dispenser assembly. The present invention also incorporates a unique dispensing assembly that permits effective and repeatable separation of discrete lids from a bulk stack of lids and more repeatable dispense events when lids are available. The present invention can be accomplished with inexpensive materials so as to be cost effective in price to the marketplace and provides a disposable lid dispenser assembly that is intuitive to operate and deploy for both users as well as service personnel associated with maintained a desired operating condition of the lid dispenser assembly.

The present invention discloses a dispenser assembly and method of forming a dispenser assembly for disposable container lids and that is constructed to sequentially dispense respective container lids from a stack of container lids housed in the dispenser assembly. The dispenser assembly is generally defined by a tube, a pressure plate assembly and a door assembly. The door assembly is movable relative to the tube to allow loading of the tube with a stack of lids and supports a cover that is moveable relative to a door. The door and cover cooperate with one another to define an extraction gap shaped to allow manual extraction of a discrete lid from the stack of lids contained in the dispenser assembly. A plurality of deflectable projections extend across the extraction gap and operate to ensure separation of a discrete lid from the remainder of the stack of lids during each extraction event.

Another aspect of the present invention that is combinable or useable with one of more of the above features, objects, or aspects of the present application discloses a disposable lid dispenser assembly having a tube shaped to receive a stack of lids. A push plate is disposed in the tube and is slideable relative thereto to urge the stack of lids toward a dispense end of the tube. A door is disposed over the dispense end of the tube and is moveable relative to the tube between a closed orientation and an open orientation. A dispense opening is formed through the door and shaped to allow extraction of a discrete lid from the stack of lids through the door when the door is in the closed orientation. A cover is movably connected to the door and extends over a portion of the dispense opening defined by the door.

A further aspect of the present invention that is combinable or useable with one of more of the above features, objects, or aspects discloses a lid dispenser assembly having a sleeve that is shaped to receive a stack of container lids. A push plate is slideably disposed in the sleeve and biased toward a dispense end of the sleeve. A door is connected to the sleeve and moveable between a closed position and an open position. A cover is connected to the door that extends across a portion of an opening defined by the door such that an extraction gap is defined between the door and the cover. A plurality of deflectable projections extend from the door across the extraction gap and overlap a portion of the cover so that, during each lid extraction event, a discrete lid being extracted is separated from the remaining available stack of lids.

Another aspect of the present invention that is useable or combinable with one of the more of the above features, objects, and/or aspects discloses a method of forming a lid dispenser assembly that includes providing a tube shaped to receive a stack of lids. A pressure plate is provided and constructed to slideably cooperate with the tube and operable to bias the stack of lids toward a dispense end of the tube. A door is provided that is rotatable relative to the tube between a closed position wherein the door overlies the pressure plate and an open position wherein the door is located outside an imaginary footprint defined by the stack of lids. The method includes providing a cover that is movable relative to the door and providing a plurality of flexible projections that extend across a gap defined between the door and cover and shaped to allow manual extraction of a discrete lid of the stack of lids from the tube and effectuate separation of the discrete lid from a remainder of the stack of lids. Cooperation of cover with the door allows limited translation of the cover relative to the door to provide extraction of discrete lids and separation of the lid from the remainder of the stack of available lids without damaging the lid being extracted or a subsequent or adjacent lid of the stack.

These and other aspects, objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications. Other features, objects, aspects, and advantages of the invention are made apparent from the following description taken together with the drawings. It is further appreciated that the various features, aspects, objects, and advantages disclosed above are not mutually exclusive to the specific aspects of the invention such that the various discrete features, aspects, objects, and advantages are usable and/or combinable with one another.

DESCRIPTION OF THE DRAWINGS

The drawings illustrate the best mode presently contemplated of carrying out the invention.

In the drawings.

Figure 1:
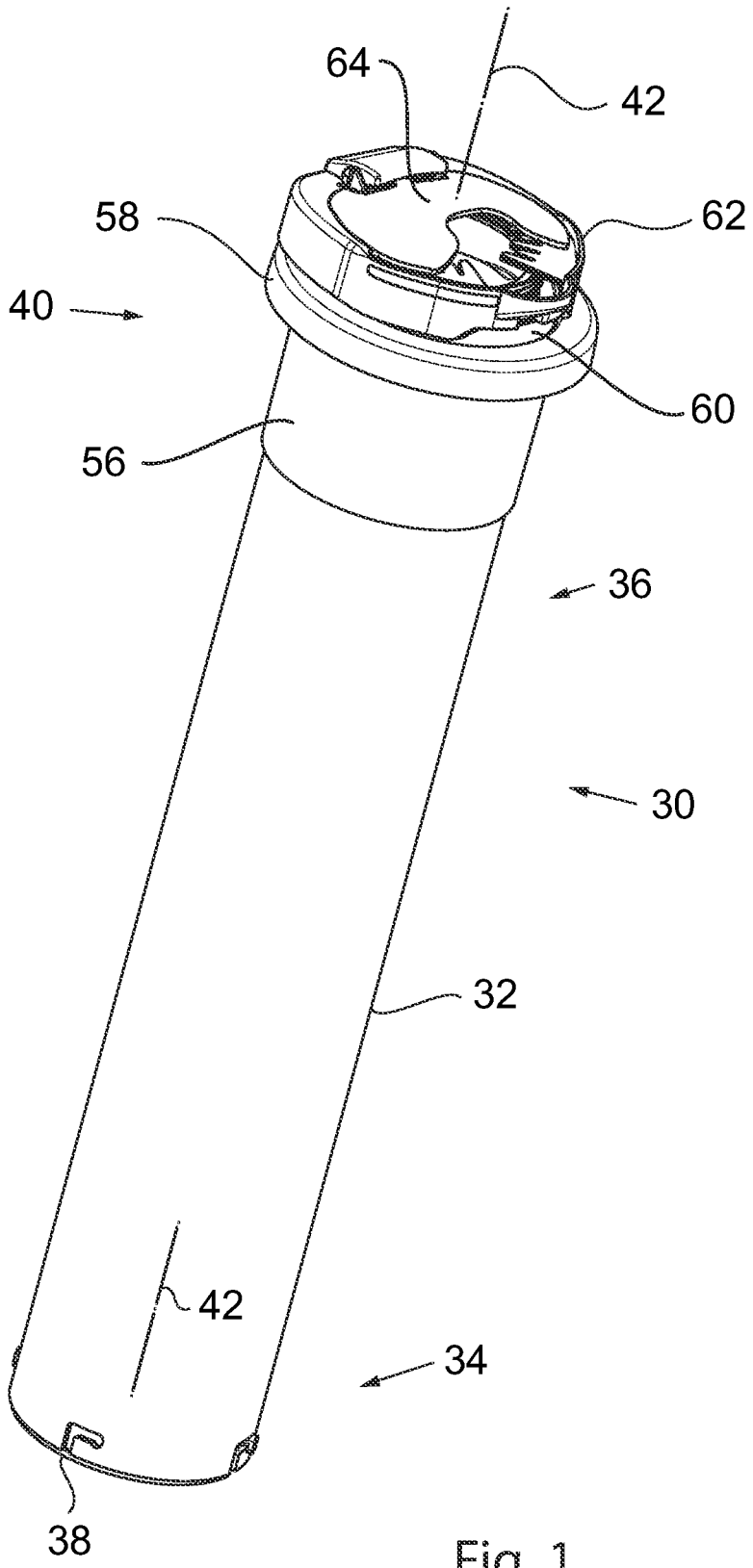
FIG. 1 is a perspective view of a dispenser assembly according to the present invention and having an exemplary stack of disposable lids disposed therein.

Various aspects of the invention are described in detail with reference to the drawings, wherein like reference numerals, including the reference numeral designations, represent like parts and assemblies throughout the several views. Reference to one embodiment does not limit the scope of the claims attached hereto. Additionally, any examples set forth in this specification are not intended to be limiting and merely set forth some of the many possible embodiments for the appended detailed description and claims.

DETAILED DESCRIPTION OF THE PREFERRED EMBODIMENT

Figure 2:
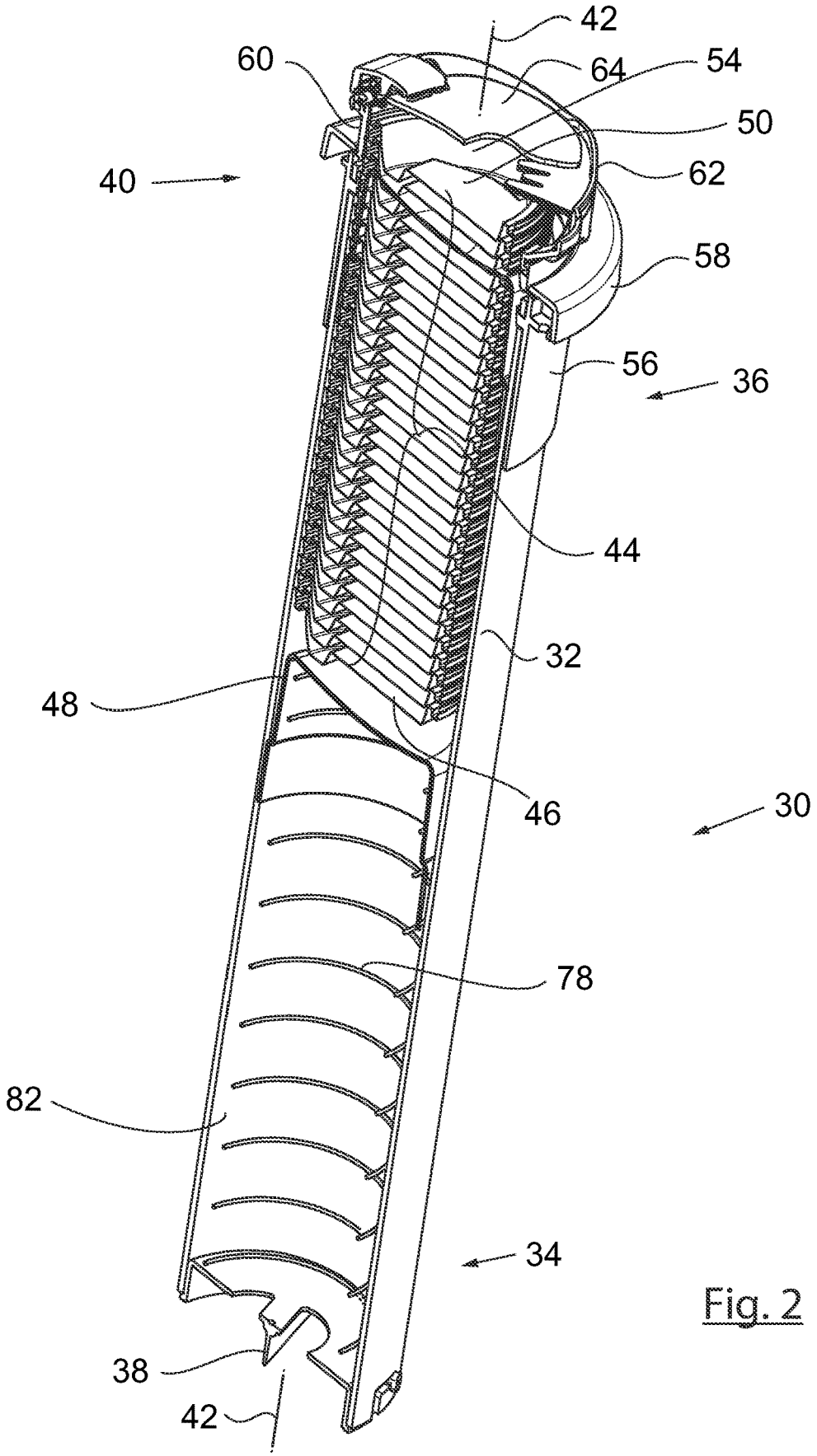
FIG. 2 is perspective cross section view of the dispenser assembly shown in FIG. 1 along line 2-2 shown in FIG. 5.

The present invention discloses an apparatus, assembly, method for providing, and method for dispensing disposable container lids in a sanitary manner and manner in which a single lid is dispensed during manual extraction events associated with user interaction with the dispenser assembly. Referring to FIGS. 1 and 2, a container lid dispenser assembly or dispenser assembly 30 according to the present invention includes a sleeve or tube 32 that is generally defined by a base or lower end 34 and a dispense or upper end 36. Although terms such as "upper" and "lower" are used herein to define the relative location of discrete portions of dispenser assembly 30, it is to be appreciated that use of such terms has no gravitational connotation in as much as the dispenser assembly disclosed herein can be deployed in any of a vertical orientation, a horizontal orientation, or any angle therebetween without detracting from the operability thereof.

A bottom or base plate 38 is secured to lower end 34 of tube 32 and a closure assembly 40 is attached to upper end 36 thereof. Tube 32 is defined by an elongate body that extends along an axis, indicated by line 42, and which is shaped to receive a stack of disposable cup lids 44 therein. Stack 44 includes a bottom or lowermost lid 46 that is generally disposed adjacent a pressure plate 48 and an uppermost or next to be dispensed lid 50 that is positioned generally behind closure assembly 40. Discrete lids of stack of lids 44 are nested relative to one another and are oriented relative to tube 32 such that a cup facing surface 54 of discrete lids of stack of lids 44 faces toward an underside of closure assembly 40 during use of dispenser assembly 30.

Closure assembly 40 includes a mount body or mount ring 56 that is constructed to be engaged with upper end 36 of tube 32. A trim ring 58 and door mount 60 cooperate with mount ring 56 so as to be supported by tube 32. A door 62 is pivotably connected to door mount 60 so as to be rotational relative thereto and, as disclosed below, movable between a closed position wherein the door 62 overlies stack of lids 44 and an open position wherein a stack of lids can be slideably associated with the cavity defined by tube 32. A cover 64 is supported by door 62 and attached thereto so as to be movable relative thereto. As disclosed further below, the cooperation of door 62 and cover 64 of closure assembly 40 facilitate the sequential manual extraction of the uppermost lid 50 of stack of lids 44 during user interaction therewith.

Figure 3:
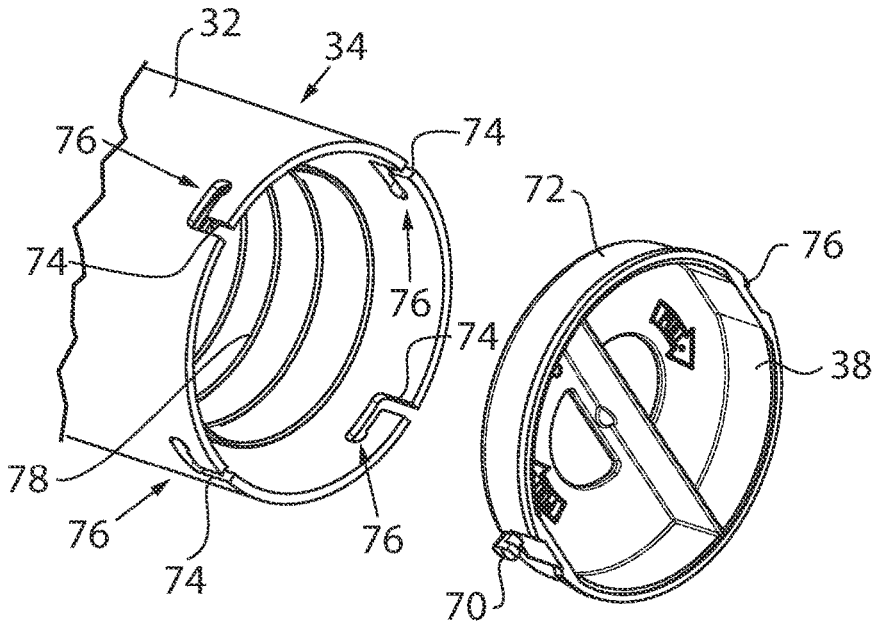
FIG. 3 is a perspective view of a bottom end of the dispenser assembly shown in FIG. 1 with a bottom plate exploded from a tube of the assembly.

As shown in FIGS. 2 and 3, base plate 38 includes one or more projections 70 that extend in an outward radial direction relative to a wall 72 of base plate 38. Respective projections 70 cooperate with respective grooves or channels 74 defined by lower end 34 of tube 32 when base plate 38 is engaged therewith. Rotation of base plate 38 relative to tube 32 allows projections 70 to rotate toward the discrete closed end 76 associated with respective channels 74 so as to secure base plate 38 relative to tube 32. It is appreciated that other methodologies, such as threadable connections or the like, may be employed to secure base plate 38 relative to tube 32. A biasing device, such as a compression spring 78 or the like, is disposed between base plate 38 and pressure plate 48. Pressure plate 48 is slidable relative to an interior wall 82 of tube 32 and urged via the operation of spring 78 to bias stack of lids 44 toward closure assembly 40.

Figure 4:
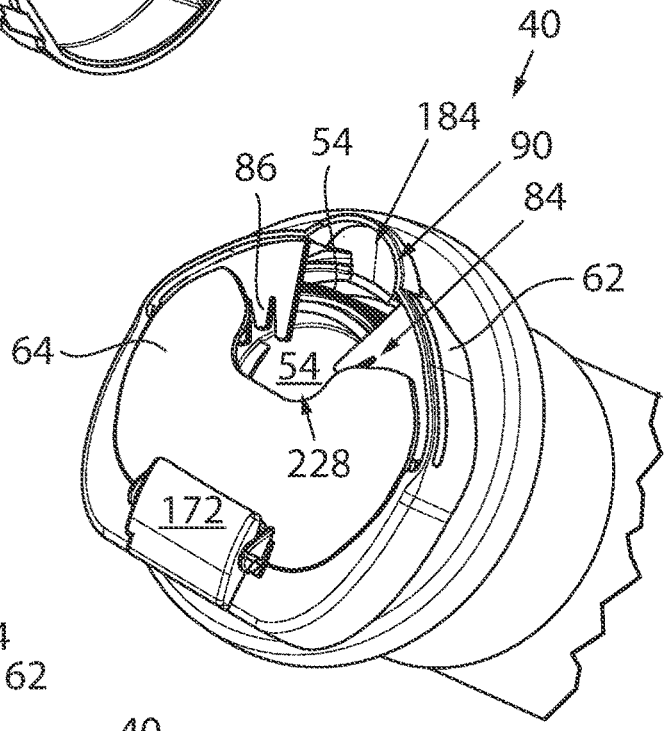
FIG. 4 is a perspective view of a dispense end of the dispenser assembly shown in FIG. 1.
Figure 5:
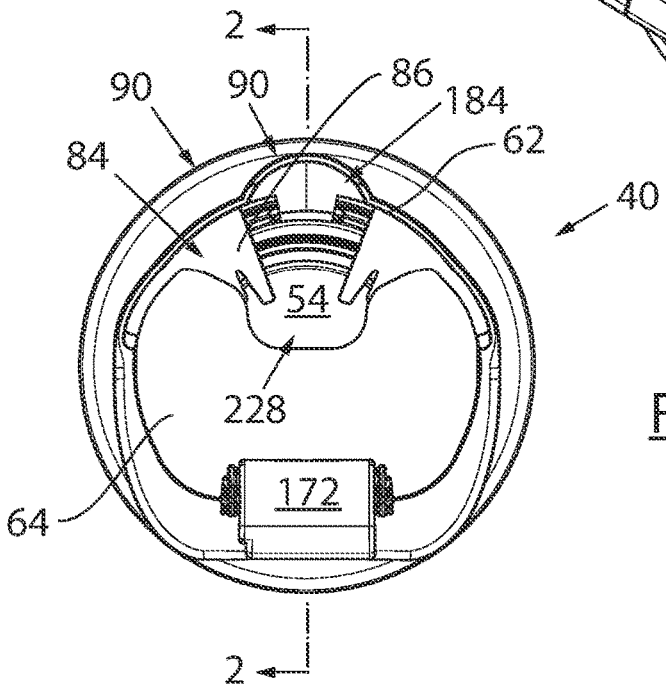
FIG. 5 is a plan view of the dispense end of the dispenser assembly shown in FIG. 1.
Figure 6:
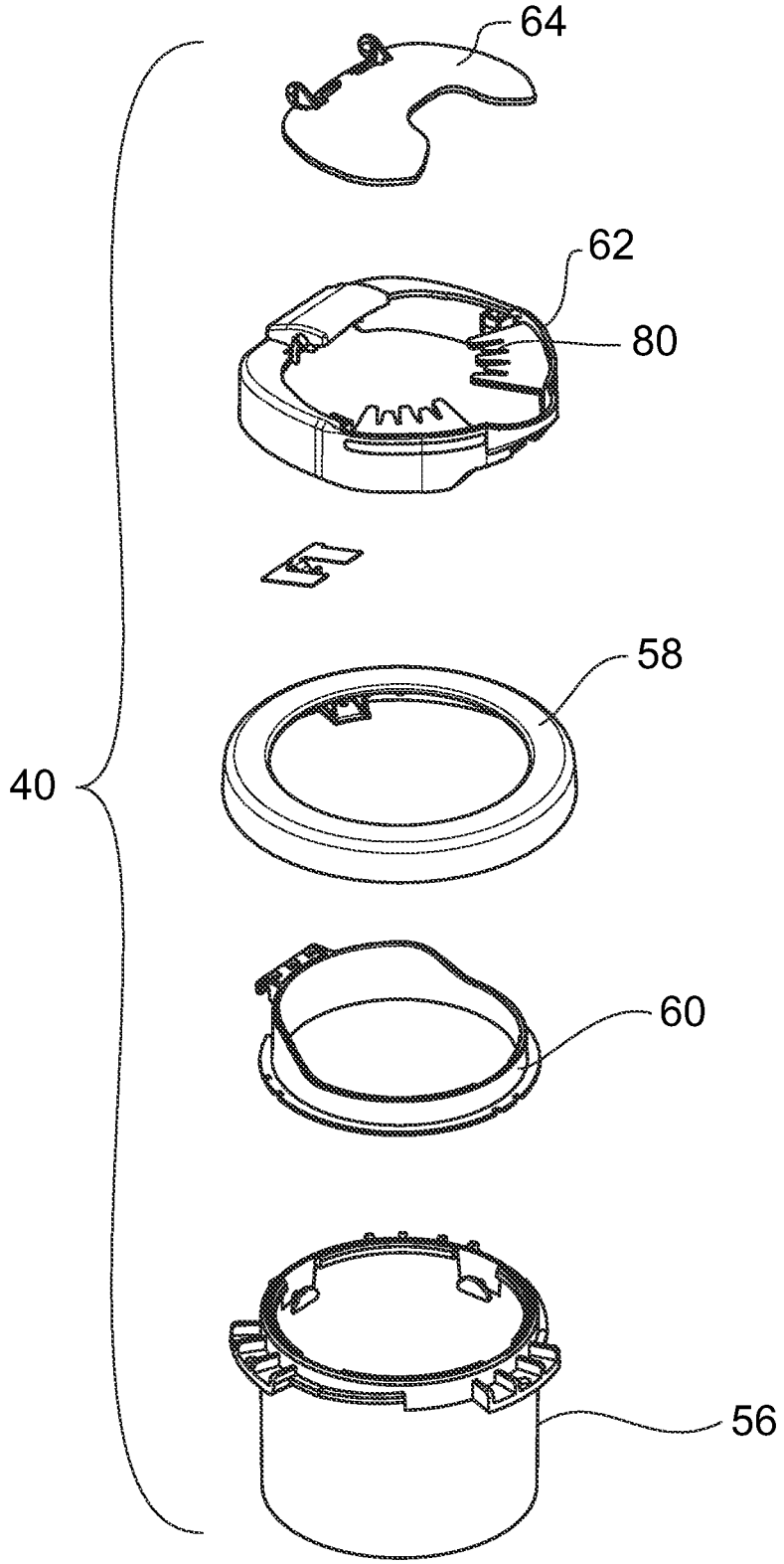
FIG. 6 is a perspective exploded view of a closure assembly of the dispenser assembly shown in FIG. 4 with the tube removed therefrom.

Referring to FIGS. 4-6, cover 64 is connected to door 62 so as to be movable relative thereto. As disclosed further below, the motion of cover 64 relative to door 62 is limited by the structural cooperation between cover 64 and door 62. When cover 64 is oriented in a "most closed" orientation relative to door 62, a gap 84 is formed between a portion of door 62 and cover 64. As disclosed further below, gap 84 is configured to allow a non-marring or damaging manual extraction of discrete lids from stack of lids 44 while facilitating separation between a discrete lid being extracted and the remainder of the stack of available lids.

Still referring to FIGS. 4-6, a plurality of deflectable projections or fingers 86 extend in an inward radial direction from an inward radial facing surface of door 62 toward cover 64 and across at least a portion of gap 84 between door 62 and cover 64. Preferably, at least some of fingers 86 overlie an underside of cover 64 when cover 64 is oriented in a "closed" position. Although cover 64 is movable between a "closed" orientation and an "open" orientation relative to door 62, cover 64 does not fully obstruct the passage defined by door 62 via the operation of the partial gap 84 formed between a portion of the circumference therebetween. As disclosed further below, fingers 86 are preferably constructed to accommodate rotational translation of cover 64 thereacross during user interaction with dispenser assembly 30.

A grip site or grip window 90 is defined by the cooperation of door 62 and cover 64 and is configured to allow a finger and thumb, or pair of fingers, of the user to pass generally beneath cover 64 to engage in uppermost lid 50 of stack of lids 44 disposed in dispenser assembly 30 during each lid extraction event. As disclosed further below, inward rotational translation of cover 64 relative to door 62, and the offsetting of fingers 86 to the generally circumferentially opposite sides of grip window 90, allows a user to pinch a respective edge of uppermost lid 50 and remove the gripped lid from dispenser assembly 30. The slidable translation of the discrete lid 50 with fingers 86 effectuates a desired separation between uppermost lid 50 and any subsequent lids associated with the lid stack 44 that may remain engaged therewith, during each extraction event.

Figure 7:
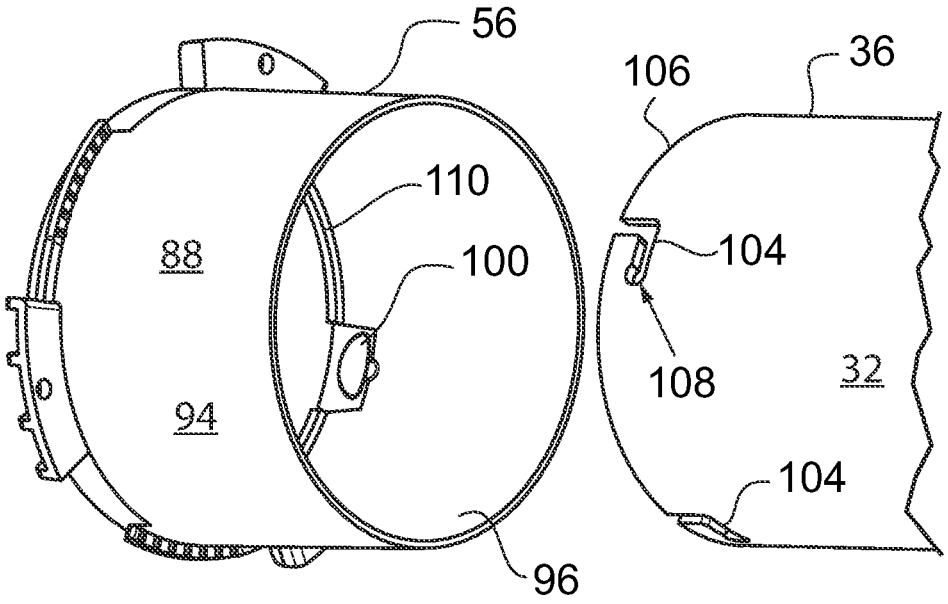
FIG. 7 is a perspective view of a mount ring of the closure assembly shown in FIG. 6 exploded from the tube of the dispenser assembly shown in FIG. 1.
Figure 8:
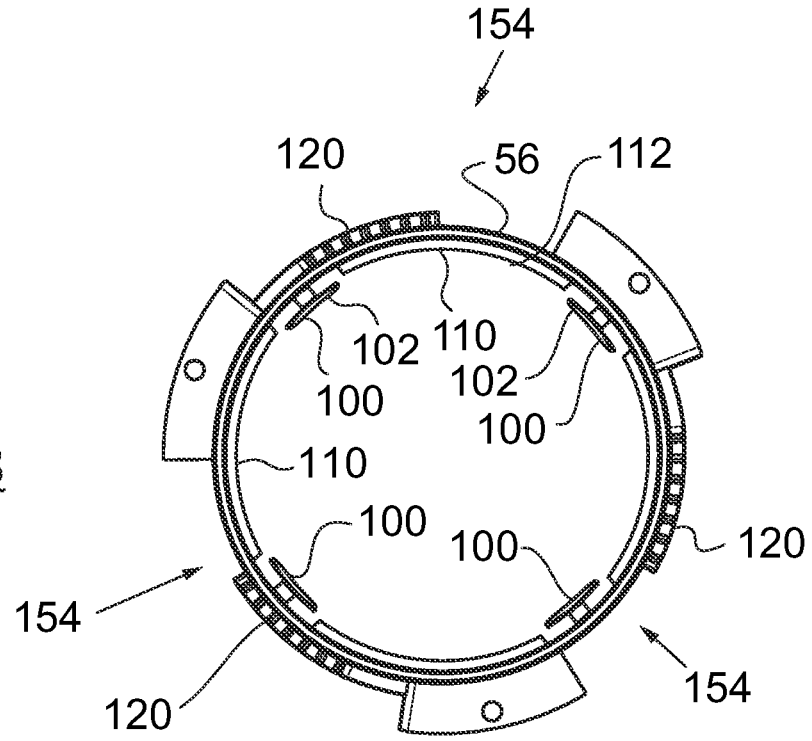
FIG. 8 is a plan view of a tube facing end of the mount ring shown in FIG. 6.
Figure 9:
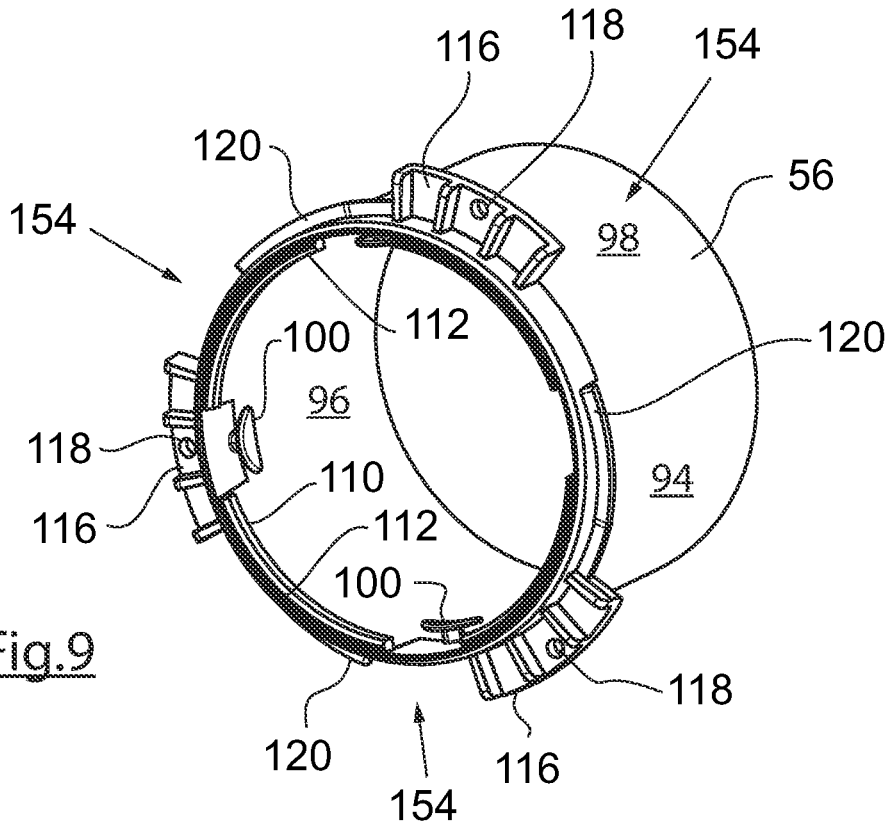
FIG. 9 is a perspective view an upward facing end of the mount ring shown in FIG. 6.

Referring to FIGS. 7-9, mount ring 56 of closure assembly 40 is generally defined by a circular body 94 having an inner radial surface 96 and an outer radial surface 98. A plurality of posts 100 extend radially inward from inner radial surface 96 of mount ring 56. Each post 100 includes a top 102 that extends in an outward radial directions relative to the direction of extension of each discrete post 100. Like lower end of tube 32, upper end 36 of tube 32 includes respective channels 104 that are disposed circumferentially about a terminal end 106 of upper end 36 of tube 32 and positioned to cooperate with respective posts 100. Relative rotation between mount ring 56 and tube 32 allow respective posts 100, when engaged with respective channels 104, to be rotated toward a closed end 108 of the discrete channels 104 thereby securing mount ring 56 to tube 32.

A rib 110 extends in an inward radial direction relative to interior facing radial surface 96 of mount ring 56 about at least a portion of the circumference thereof. That is, rib 110 may be continuous or defined by a number of discrete sections. As disclosed further below, respective sections of rib 110 define an upwardly facing seat 112 that is constructed to engage door mount 60 when closure assembly 40 is assembled. As disclosed further below, seat 112 of mount ring 56 limits inward axial translation of door mount 60 relative to mount ring 56. One or more flanges 116 extend in an outward radial direction from outer surface 98 of mount ring 56. One or more holes 118 are formed through one or more of flanges 116 and can be employed, with the cooperation of suitable fastener or the like, to secure mount ring 56 relative to a support structure, such as a countertop, a housing or faceplate, or the like, when tube 32 is secured thereto. One or more ribs 120 also extend in an outward radial direction from mount ring 56 proximate flanges 116. As disclosed further below, ribs 120 are constructed to facilitate securing of trim ring 58 to mount ring 56 after door mount 60 has been positionally associated therewith.

Figure 10:
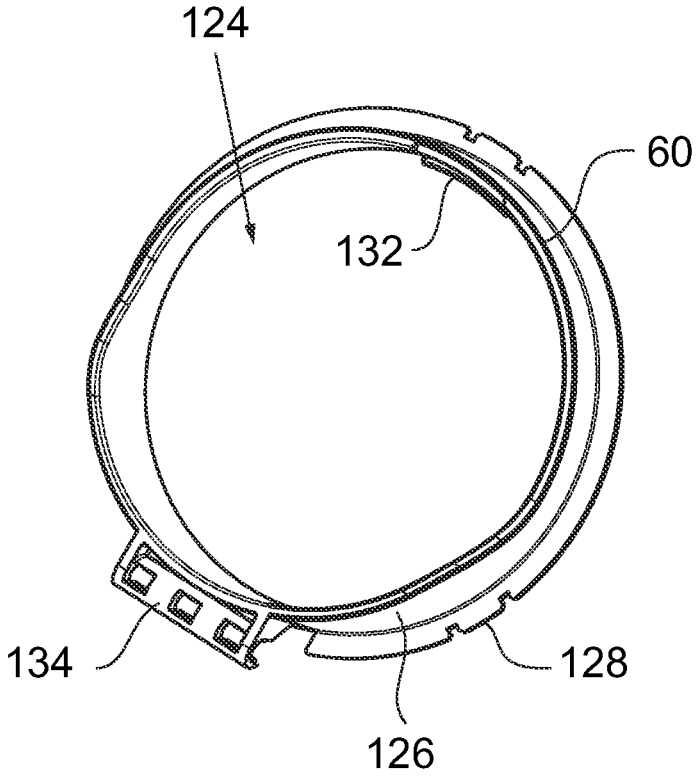
FIGS. 10 and 11 are perspective views of a door holder of the closure assembly shown in FIG. 6.
Figure 11:
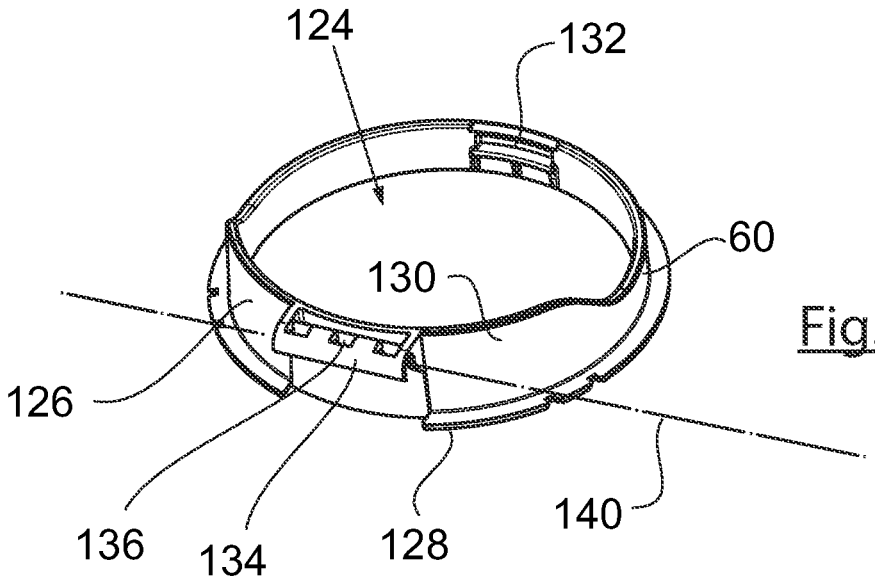
Figure 12:
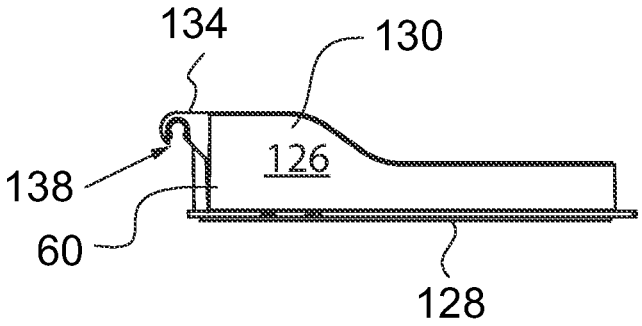
FIG. 12 is side elevation view of the door holder shown in FIGS. 10 and 11.

Referring to FIGS. 10-12, door mount 60 defines a passage 124 formed therethrough. Door mount 60 is defined by a body 125 that includes a flange 128 that extends in an outward radial direction therefrom. When assembled, flange 128 is constructed to nest within mount ring 56 and engage seat 112 associated with the respective upward facing end thereof. Door mount 60 includes an upstanding wall 130 that generally circumscribes passage 124. A door catch 132 is formed on a radially inward facing surface of wall 130 of door mount 60. As disclosed further below, door catch 132 is constructed to selectively cooperate with a latch defined by door 62 to allow the selective opening and closing of door 62 relative to tube 32.

Generally opposite catch 132, and formed on a radially outward directed surface of wall 130, door mount 60 includes a hinge portion 134 that is constructed to receive a biasing device, such as a torsion spring 136 or the like, and constructed to cooperate with door 62. Hinge portion 134 defines a channel 138 constructed to snap fittingly receive a meeting hinge portion or hinge pin of door 62 as described further below such that door 62 is rendered selectively rotatable relative to door mount 60 when attached thereto. Channel 138 defines an axis of rotation, indicated by line 140, of door 62 relative to door mount 60 when closure assembly 40 is assembled. The radially outboard orientation of hinge portion 134 relative to passage 124 allows door 62 to rotate from a "closed" position or orientation wherein door 62 generally overlies passage 124 defined by door mount 60, and thereby the cross sectional foot print of the area bounded by tube 32, and an "open" position or orientation wherein door 62 is located laterally outboard of an imaginary footprint defined by passage 124 and thereby the cross sectional area bounded by tube 32. As disclosed further below, such a consideration allows door 62 to be rotated to a position or orientation wherein door 62 does not overlie stack of lids 44 and/or pressure plate 48 so as to accommodate reloading of dispenser assembly 30 when necessary or desired.

Figure 13:
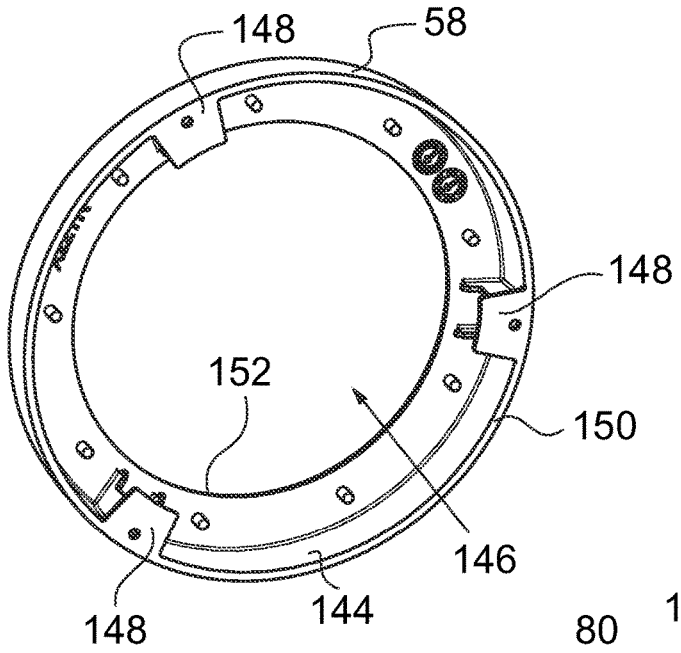
FIG. 13 is a perspective view of an underside or tube facing side of a trim ring of the closure assembly shown in FIG. 6.
Figure 14:
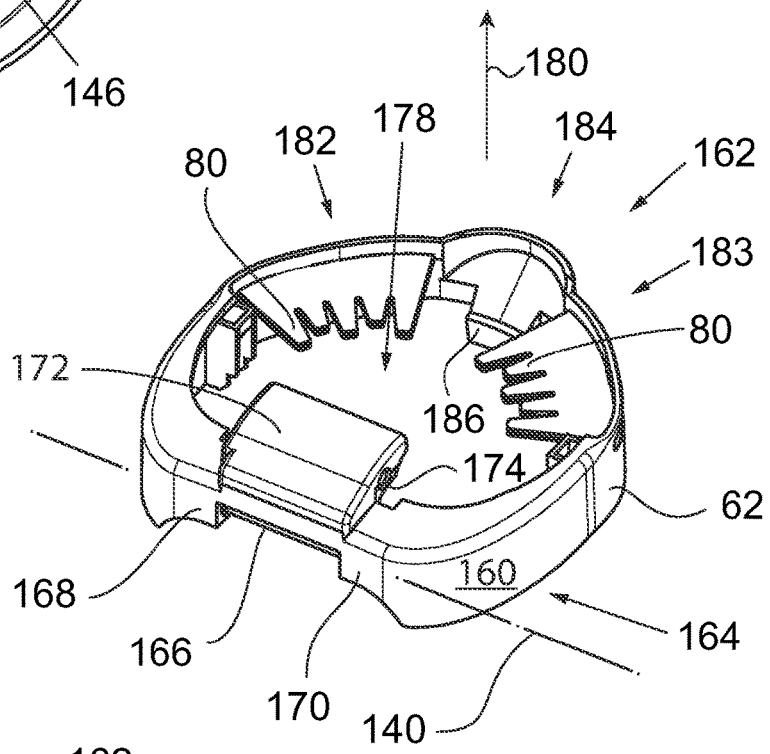
FIGS. 14-17 are various views of a door of the closure assembly shown in FIG. 6.
Figure 15:
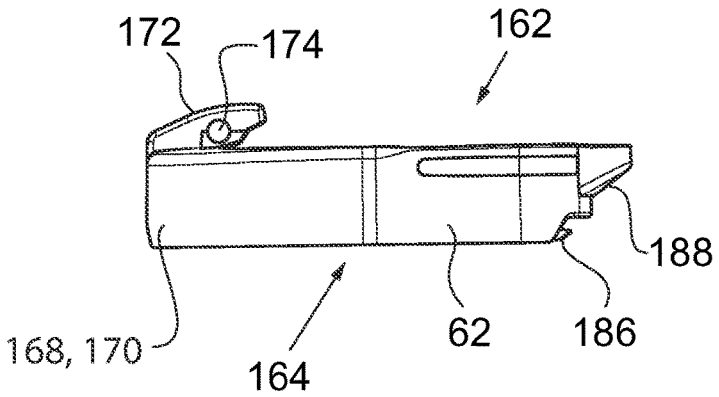

As shown in FIG. 13, trim ring 58 is defined by a body 144 having an opening 146 formed therein and one or more projections 148 that extend in an inward radial direction relative to an outer radial edge 150 of trim ring 58. Referring to FIGS. 9 and 13, projections 148 of trim ring 58 are circumferentially spaced about trim ring 58 and index relative to respective gaps 152 (FIG. 9) between the outward radially extending ribs 120 of mount ring 56. Subsequent rotation of trim ring 58 relative to mount ring 56 allows projections 148 to cooperate with respective ribs 120 which extend from mount ring 56 to secure trim ring 58 relative thereto during assembly of closure assembly 40. Opening 146 of trim ring 58 is defined by a radial perimeter 152 that is slightly larger than a diameter of upstanding wall 126 of door mount 60 such that upstanding wall 126 of door mount 60 extends through trim ring 58. During assembly, flange 128 of door mount 60 nests relative to seat 112 defined by mount ring 56 and the subsequent rotational translation of trim ring 58 after axial translation of projections 148 through gaps 154 secures trim ring 58 to mount ring 56 with flange 128 of door mount 60 captured between mount ring 56 and trim ring 58 while wall 126 and hinge portion 134 of door mount 60 project beyond an upwardly directed surface of trim ring 58 and are accessible for cooperation and securing of door 62 thereto.

FIGS. 14 through 17 show various views of door 62 of closure assembly 40. Door 62 is defined by a body 160 having an upward or outward facing end 162 and an inward or door support facing end 164. A hinge pin 166 extends between a pair of bosses 168, 170 that extend from door support facing side 164 of door 62 such that hinge pin 166 is constructed to snap fittingly cooperate with channel 138 associated with hinge portion 134 defined by door mount 60. A projection or arm 172 extends in a slightly upward and generally radially inward direction relative to an axis 140 of rotation associated with hinge pin 166. Respective cavities 174 are formed in generally opposite lateral edges of arm 172 and are constructed to snap fittingly cooperate with cover 64. As disclosed further below, when cover 64 is attached to door 62, cover 64 is rotational in an inward rotational direction, or a directed toward stack of lids 44, relative to door 62 and facilitates user interaction with the uppermost lid 50 of the stack of lids 44.

Plurality of fingers 80 extend in an inward radial direction relative to a passage 178 defined by a body 160 of door 62. Projections 80 are formed of a flexible material, such as a plastic, silicone, or rubber material, and discretely deflectable during each extraction event as a respective uppermost lid 50 passes therealong in an upward axial direction, indicated by arrow 180. Plurality of projections 80 may be provided in various configurations and may include projections that extend radially further into passage 178 than others of the plurality of projections. It is further appreciated that one or more of projections 80 may extend in respective inward or outward radial directions relative to the longitudinal axis of tube 32. Projections 80 are further preferably segregated into a first group of projections 182 and a second group or projections 183 that are oriented along generally opposite circumferential sides of the respective portion 184 of the lid grip site defined by body 160 to allow passage of the user's thumb or finger into the area generally bounded by body 160 of door 62.

A latch 186 is disposed generally beneath grip site 184 and oriented to snap fittingly cooperate with catch 132 of door mount 60 when hinge pin 166 of door 62 is engaged with hinge portion 134 of door mount 60 and when door 62 is oriented in the closed position relative to door mount 60. Catch 186 is constructed to be deflectable so as to disengage catch 132 when opening of door 62 is desired. User interaction with an exterior surface 188 of grip site 184 allows an upwardly directed force to be imparted to door 62 so as to effectuate disengagement of catch 186 relative to catch 132 and thereby facilitate rotation of door 62 about the axis defined by hinge pin 166 so as to be rotated toward an "open" position wherein a stack of lids 44 may be slidably associated with tube 32 during reloading or service operations.

Figure 16:
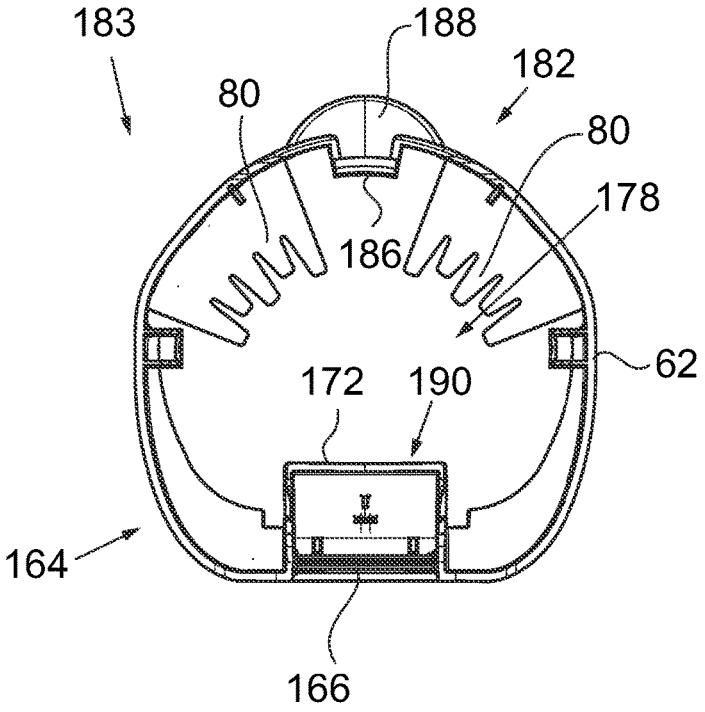
Figure 18:
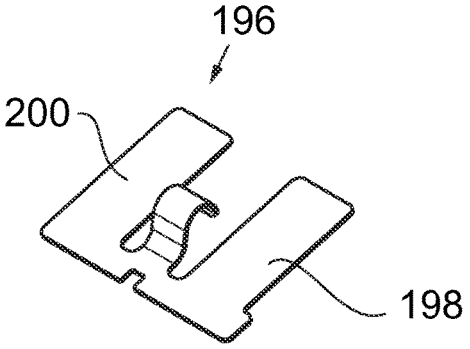
FIG. 18 is a perspective view of a biasing device disposed between the door and a cover of the closure assembly shown in FIG. 6.
Figure 17:
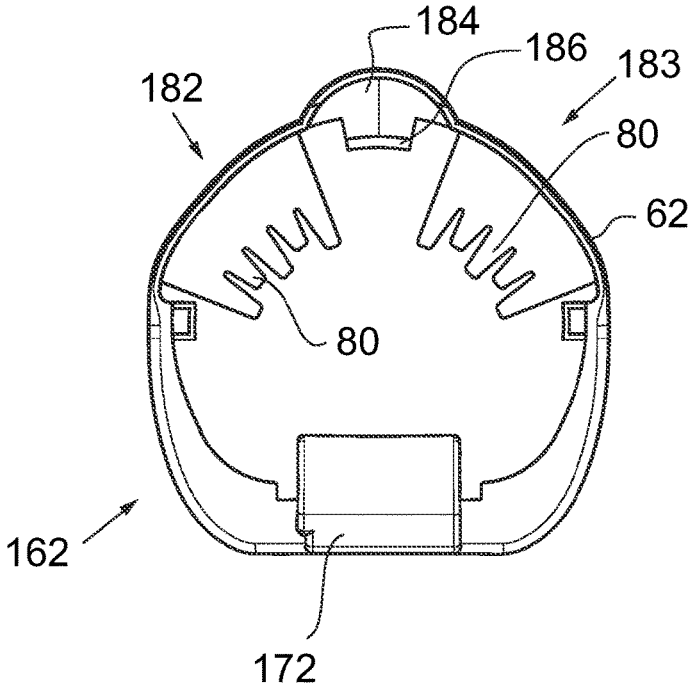

Referring to FIGS. 16-18, an underside or door mount facing surface of arm 172 of door 62 includes a cavity 190 formed therein and located generally radially inward relative to hinge pin 166. Cavity 190 is shaped to cooperate with a biasing device 196, such as a plate spring that is operable to urge cover 64 toward a "closed" position or orientation relative to door 62. Plate spring 196 includes respective arms 198, 200 and is disposed between door 62 and cover 64 so as to allow the inward radial translation of cover 64 relative to door 62 and return cover 64 toward the "closed" orientation generally shown in FIG. 4 wherein cover 64 substantially interferes with or overlies the cross sectional area of passage 178 defined by door 62 aside from the area associated with gap 84 between cover 64 and door 62.

Figure 19:
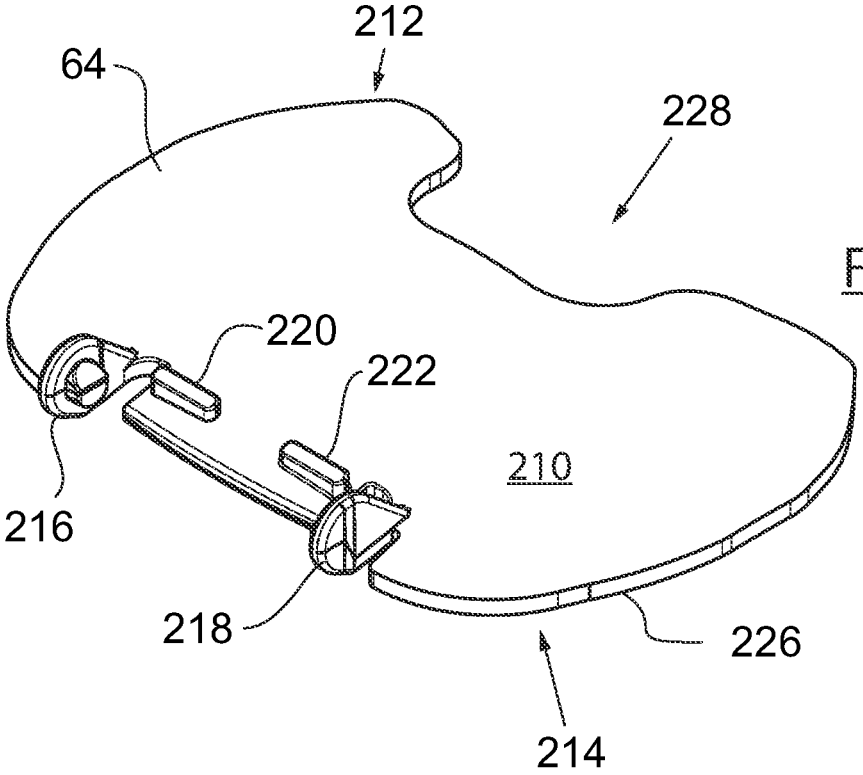
FIGS. 19 and 20 are perspective views of a cover of the closure assembly shown in FIG. 6.
Figure 20:
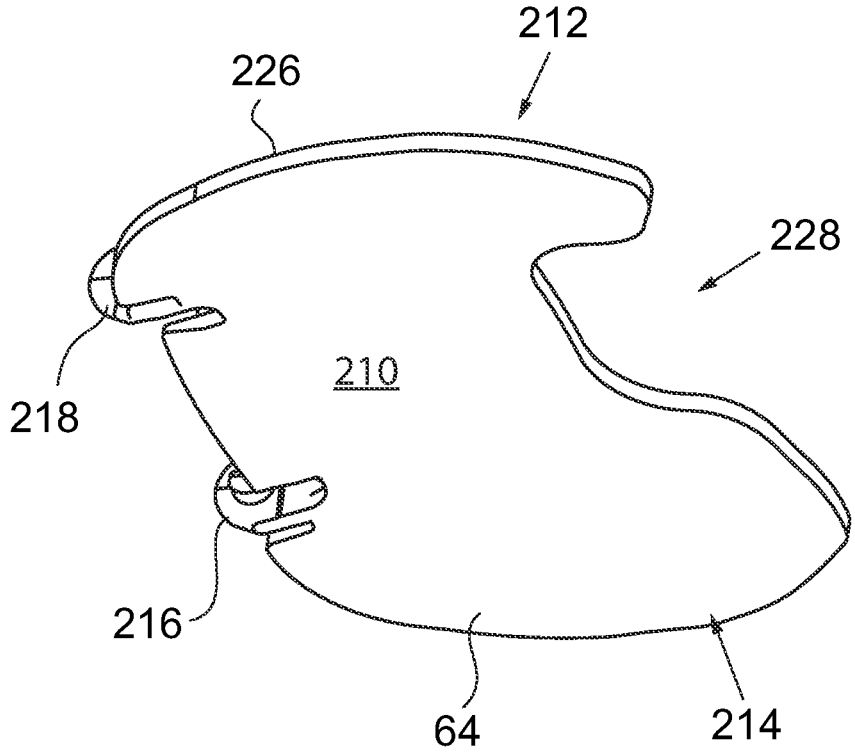

As shown in FIGS. 19 and 20, cover 64 is defined by a body 210 having an upward facing surface 212 and a lid facing surface 214. A pair of bosses 216, 218 extend in an upward direction from the upward facing surface 212 of body 210 of cover 64 and snap fittingly cooperate with respective cavities 174 defined by arm 172 of door 62. A pair of projections 220, 222 extend from the upward facing surface 212 body 210 of cover 64 and engage plate spring 196 when cover 64 is pivotably secured to door 62. Body 210 is defined by a perimeter 226 that includes a cut out or grip site 228 that forms a respective portion of grip site 184 associated with allowing a person's thumb or finger to pass between cover 64 and door 62 and interact with uppermost lid 50 during each extraction event.

Figure 21:
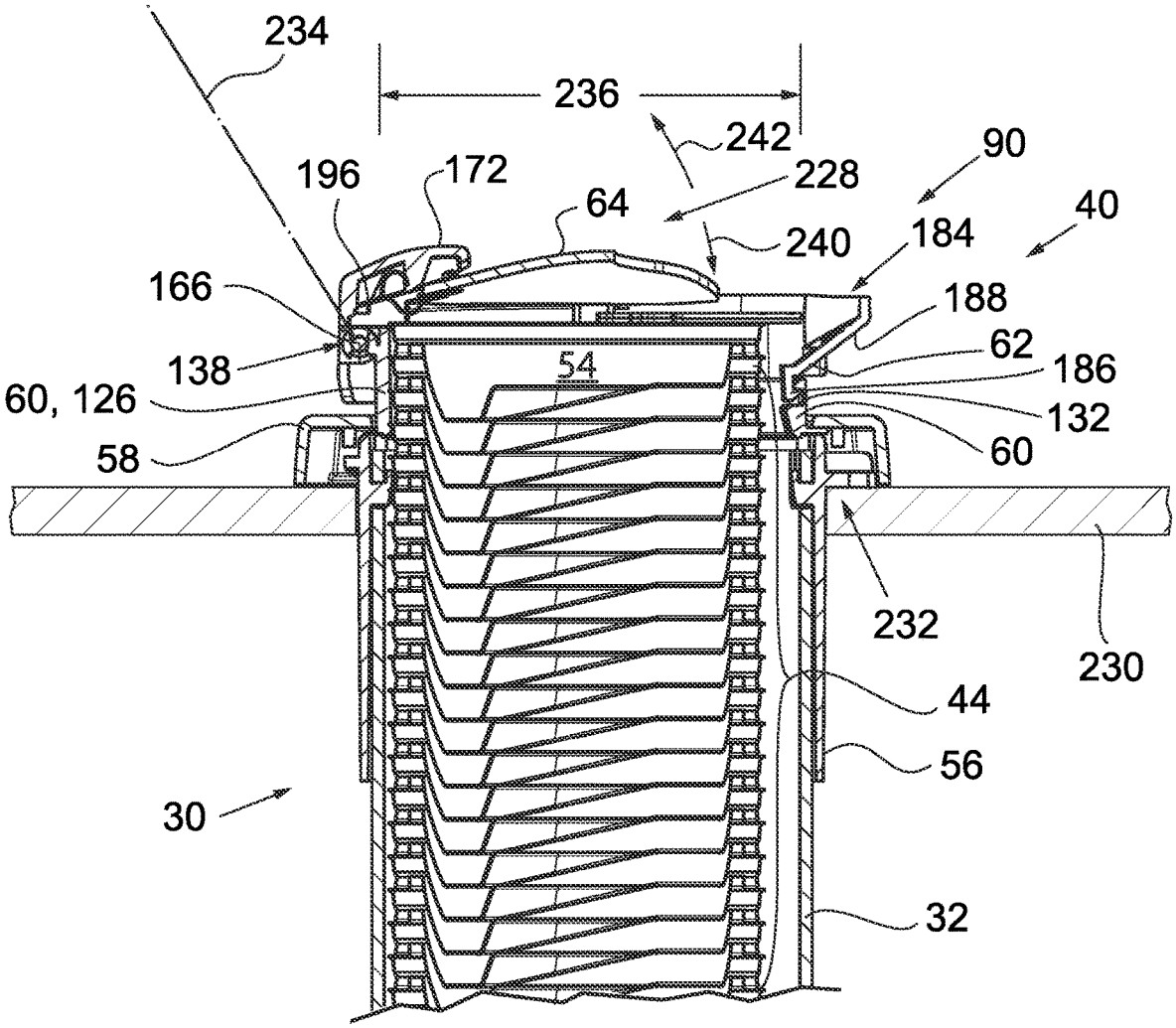
FIG. 21 is a cross section view of the dispense end of the dispenser assembly shown in FIG. 1 along line 2-2 shown in FIG. 5.

As shown in FIG. 21, when deployed, tube 32 is secured to mount ring 56 which is subsequently secured to a support surface, such as a housing, faceplate, countertop 230, or the like. Mount ring 56 passes through an opening 232 formed in support surface 230 such that a majority of the mount ring 56 and tube 32 are generally disposed and extend therebehind. Wall 126 of door mount 60 passes through trim ring 58 and is accessible from above countertop 230. Hinge pin 166 of door 62 snap fittingly cooperates with channel 138 of door mount 60 such that door 62 is rendered rotational relative thereto. When closed, as shown in FIG. 21, latch 186 and catch 132 cooperate with one another so as to secure door 62 relative to door mount 60 and such that, with application of suitable force is imparted to surface 188 of door 62, the user can effectuate disengagement between catch and latch 132, 186 and facilitate rotation of door 62 about the axis defined by hinge pin 166 to attain an "open" orientation of door 62 and cover 64, indicated by line 234, wherein door 62 and the cover 64 associated therewith are rotated to a position wherein the door 62 and cover 64 do not overlie the imaginary vertical footprint, indicated by line 236, associated with the stack of lids 44 and the axial volume defined by tube 32 when dispenser assembly 30 is rendered empty and/or requires refilling, replenishment, or service. The pivotable connection of cover 64 with door 62 allows inward rotational translation, indicated by arrow 240, of cover 64 relative to door 62 during user interaction with grip window 90 to provide sufficient access to the uppermost lid 50 of the lid stack 44. Arm 172 of door 62 extends radially over a portion of cover 64 and renders cover 64 incapable of outwardly directed rotational translation, indicated by arrow 242, relative to door 62 beyond the orientation shown in FIG. 21.

Referring to FIGS. 4, 5, and 21, during an extraction event, a user can introduce a respective pair of a thumb and/or fingers into window 90 defined by a combination of the space afforded by grip window 90 associated with door 62 and grip site 228 defined by cover 64 to interact with the discrete uppermost lid 50 of the stack of lids 44. If necessary, cover 64 can rotate in an inward rotational direction via the pivotable connection between cover 64 and arm 172 of door 62 to allow the user sufficient access to securely grip discrete uppermost lid 50 disposed therebehind. Once gripped, and during upward translation of the respective uppermost lid 50 relative to door 62 and cover 64, the overlapping interference between cover 64 and arm 172 limits upward rotational translation of cover 64 relative to door 62 beyond the orientation shown in FIG. 21 while discrete projections 80 slidably cooperate with the exterior radial edge of discrete lid 50 and facilitate extraction of discrete uppermost lid 50 via the gap 84 formed between the passage defined by door 62 and the circumferential boundary defined by cover 64 disposed thereover. Such a construction ensures repeatable separation of the discrete uppermost lid 50 from the remainder of the adjoining stack of lids 44 during each extraction event and allows extraction of the discrete uppermost lid 50 in a non-marring or nondamaging manner such that discrete uppermost lid 50 is left usable for its intended purpose of engagement with a disposable container.

Pressure plate 48 and compression spring 80 cooperate with the bottommost lid 46 of stack of lids 44 so as to maintain the desired presentation of a respective terminal uppermost lid 50 associated with the upward facing end of stack of lids 44 until the respective stack of lids is otherwise depleted and/or refilling of dispenser assembly 30 is desired. The cooperation of the catch 132 and the latch 186 between door 62 and door mount 60 is configured to allow user interaction with dispenser assembly 30 during each dispense event without effectuating undesired separation therebetween and/or unexpected opening of the closure assembly during user interaction therewith. Dispenser assembly 30 is constructed to provide manual sequential separation of disposable container lids from a stack of disposable container lids 44 to maintain a sanitary condition of undispensed lids and which does so in a highly repeatable manner, can be economically produced, and provides intuitive operation to both users and service personnel for both lid extraction events and dispenser reloading operations.

Although the invention has been herein shown and described in what is perceived to be the most practical and preferred embodiments, it is to be understood that the invention is not intended to be limited to the specific embodiments set forth above. Rather, it is recognized that modifications may be made by one of skill in the art of the invention without departing from the spirit or intent of the invention and, therefore, the invention is to be taken as including all reasonable equivalents to the subject matter set forth herein.

One embodiment of the invention includes a dispenser assembly and method of forming a dispenser assembly for disposable container lids and that is constructed to sequentially dispense respective container lids from a stack of container lids housed in the dispenser assembly. The dispenser assembly is generally defined by a tube, a pressure plate assembly and a door assembly. The door assembly is movable relative to the tube to allow loading of the tube with a stack of lids and supports a cover that is moveable relative to a door. The door and cover cooperate with one another to define an extraction gap shaped to allow manual extraction of a discrete lid from the stack of lids contained in the dispenser assembly. A plurality of deflectable projections extend across the extraction gap and operate to ensure separation of a discrete lid from the remainder of the stack of lids during each extraction event.

Another embodiment of the invention that is combinable or useable with one of more of the features, aspects, objects, or above embodiments includes a disposable lid dispenser assembly having a tube shaped to receive a stack of lids. A push plate is disposed in the tube and slideable relative thereto to urge the stack of lids toward a dispense end of the tube. A door is disposed over the dispense end of the tube and is moveable relative to the tube between a closed orientation and an open orientation. A dispense opening is formed through the door and shaped to allow extraction of a discrete lid from the stack of lids through the door when the door is in the closed orientation. A cover is movably connected to the door and extends over a portion of the dispense opening defined by the door.

A further embodiment of the invention that is combinable or useable with one of more of the features, aspects, objects, or above embodiments includes a lid dispenser assembly having a sleeve that is shaped to receive a stack of container lids. A push plate is slideably disposed in the sleeve and biased toward a dispense end of the sleeve. A door is connected to the sleeve and moveable between a closed position and an open position. A cover is connected to the door that extends across a portion of an opening defined by the door such that an extraction gap is defined between the door and the cover. A plurality of deflectable projections extend from the door across the extraction gap and overlap a portion of the cover.

Another embodiment of the invention that is combinable or useable with one of more of the features, aspects, objects, or above embodiments defines a method of forming a lid dispenser assembly that includes providing a tube shaped to receive a stack of lids. A pressure plate is provided and constructed to slideably cooperate with the tube and operable to bias the stack of lids toward a dispense end of the tube. A door is provided that is rotatable relative to the tube between a closed position wherein the door overlies the pressure plate and an open position wherein the door is located outside an imaginary footprint defined by the stack of lids. The method includes providing a cover that is movable relative to the door and providing a plurality of flexible projections that extend across a gap defined between the door and cover and shaped to allow manual extraction of a discrete lid of the stack of lids from the tube and effectuate separation of the discrete lid from a remainder of the stack of lids.

These and other aspects, objects, features, embodiments, and advantages of the invention will become apparent to those skilled in the art from the following claims. It should be understood, however, that the detailed description and the specific examples provided therein, while indicating preferred embodiments of the present invention, are given by way of illustration and not of limitation. Many changes and modifications may be made within the scope of the present invention without departing from the spirit thereof, and the invention includes all such modifications. Other features, objects, aspects, and advantages of the invention made apparent from the above description taken together with the drawings. It is further appreciated that the various features, aspects, objects, and advantages disclosed above are not mutually exclusive to the specific aspects of the invention such that the various discrete features, aspects, objects, and advantages are usable and/or combinable with other another.

We claim:

1. A disposable lid dispenser assembly comprising:

a tube shaped to receive a stack of lids;

a push plate disposed in the tube and slideable relative thereto to urge the stack of lids toward a dispense end of the tube;

a door disposed over the dispense end of the tube and that is moveable relative to the tube between a closed orientation and an open orientation;

a dispense opening formed through the door and shaped to allow extraction of a discrete lid from the stack of lids through the door when the door is in the closed orientation;

a cover movably connected to the door and that extends over a portion of the dispense opening defined by the door; and wherein a portion of the door overlies the cover and limits motion of the cover relative to the door.

2. The disposable lid dispenser assembly of claim 1 further comprising a base connected to an end of the tube opposite the door.

3. The disposable lid dispenser assembly of claim 2 further comprising a biasing device disposed between the push plate and the base and operable to urge the push plate toward the door.

4. The disposable lid dispenser assembly of claim 1 further comprising a mount ring connected to the end of the tube adjacent the door.

5. The disposable lid dispenser assembly of claim 4 further comprising a trim ring connected to the mount ring.

6. The disposable lid dispenser assembly of claim 5 further comprising a door holder secured to the tube by cooperation of the mount ring and the trim ring and defining a portion of a hinge shaped to cooperate with the door.

7. The disposable lid dispenser assembly of claim 1 further comprising a biasing device disposed between the door and the cover.

8. The disposable lid dispenser assembly of claim 7 wherein the biasing device is further defined as a plate spring.

9. The disposable lid dispenser assembly of claim 1 further comprising a finger channel defined by at least one of the cover and the door.

10. The disposable lid dispenser assembly of claim 1 further comprising a plurality of projections that extend from the door in an inward radial direction toward the cover.

11. A lid dispenser assembly comprising:

a sleeve shaped to receive a stack of container lids;

a push plate slideably disposed in the sleeve and biased toward a dispense end of the sleeve;

a door connected to the sleeve and moveable between a closed position and an open position;

a cover connected to the door that extends across a portion of an opening defined by the door, an extraction gap defined between the door and the cover; and a plurality of deflectable projections that extend from the door across the extraction gap and overlap a portion of the cover.

12. The lid dispenser assembly of claim 11 further comprising a bottom plate connected to the sleeve opposite the dispense end and a biasing device disposed between the push plate and the bottom plate.

13. The lid dispenser assembly of claim 11 further comprising a mount ring connected to the dispense end of the sleeve.

14. The lid dispenser assembly of claim 13 further comprising holder and a trim ring connected to the mount ring and a hinge portion defined by the holder that is constructed to engage the door.

15. The lid dispenser assembly of claim 11 further comprising an arm defined by the door and constructed to overlie a portion of the cover.

16. The lid dispenser assembly of claim 15 further comprising a spring plate disposed between the arm and the cover.

17. The lid dispenser assembly of claim 11 further comprising a grip passage having a first portion defined by the door and a second portion defined by the cover that are aligned with one another when the cover is engaged with door.

18. The lid dispenser assembly of claim 17 wherein the plurality of deflectable projections are disposed on generally opposite sides of the grip passage.

19. A method of forming a lid dispenser assembly, the method comprising:

providing a tube shaped to receive a stack of lids;

providing a pressure plate constructed to slideably cooperate with the tube and operable to bias the stack of lids toward a dispense end of the tube;

providing a door that is rotatable relative to the tube between a closed position wherein the door overlies the pressure plate and an open position wherein the door is located outside an imaginary footprint defined by the stack of lids;

providing a cover that is movable relative to the door;

providing a plurality of flexible projections that extend across a gap defined between the door and cover and shaped to allow manual extraction of a discrete lid of the stack of lids from the tube and effectuate separation of the discrete lid from a remainder of the stack of lids.

20. The method of claim 19 further comprising connecting the door to the tube with a holder that extends through a trim ring.

21. The method of claim 20 further comprising securing the trim ring to a mount ring securable to the tube.

22. The method of claim 19 further comprising disposing a spring clip between the door and the cover.

23. The method of claim 19 further comprising forming an arm on the door that extends over the cover and limits outward rotation of the cover relative to the door.

24. The method of claim 19 further comprising defining a grip channel by at least one of the door and the cover and shaping the grip channel to allow a finger and thumb to pinch and edge of a terminal one of the stack of lids.

* * * * *